US005858488A

United States Patent [19]

Cohon

[11] Patent Number: 5,858,488

[45] Date of Patent: Jan. 12, 1999

[54] HARD-BACKED LAMPSHADE

[76] Inventor: Richard Cohon, 600 Summit Ave., Hackensack, N.J. 07601

[21] Appl. No.: 829,415

[22] Filed: Mar. 31, 1997

[51] Int. Cl.[6] ..... F21V 1/12; F21V 1/22

[52] U.S. Cl. ..... 428/34.5; 428/34.7; 428/35.7; 428/36.1; 428/36.5; 362/351; 362/355; 362/356; 362/357; 362/361

[58] Field of Search ..... 428/35.7, 34.5, 428/34.6, 34.7, 36.1, 36.5; 362/351, 355, 356, 357, 358, 361, 362; 260/DIG. 24

[56] References Cited

U.S. PATENT DOCUMENTS

| | | | |
|---|---|---|---|
| 3,634,131 | 1/1972 | Foster | 442/74 |
| 4,000,114 | 12/1976 | Gordon et al. | 260/DIG. 24 |
| 4,053,208 | 10/1977 | Kato et al. | 362/355 |
| 4,539,631 | 9/1985 | Lieberman | 362/355 |
| 4,724,327 | 2/1988 | Mitchell | 428/690 |
| 5,166,230 | 11/1992 | Stecker | 428/15 |
| 5,247,019 | 9/1993 | Cozens et al. | 525/239 |

*Primary Examiner*—Rena L. Dye
*Attorney, Agent, or Firm*—Kirschstein, et al.

[57] ABSTRACT

A lampshade includes a self-supporting backing member constituted of an extruded oriented polystyrene and an additive including a light-reflecting powdered filler, especially titanium dioxide, co-extruded with the oriented polystyrene and weighing in the range of 1%–10% of the total weight of the polystyrene. A fire-retarding filler, for example, antimony oxide, is also coextruded.

18 Claims, 1 Drawing Sheet

HARD-BACKED LAMPSHADE

BACKGROUND OF THE INVENTION

1. Field of the Invention

The present invention generally relates to hard-backed lampshades and, more particularly, to improving the light reflectivity of such lampshade without sacrificing the light transmissivity through such lampshades, and without sacrificing the structural strength thereof.

2. Description of the Related Art

Lampshades for screening light from light bulbs have been made of a variety of materials. A hard-backed lampshade includes a self-supporting backing member, with or without a fabric material laminated thereon. A soft-backed lampshade includes a fabric material stretched taut over a wire frame.

For hard-backed lampshades, with which this invention is concerned, the backing member has been made of semi-rigid paper, such as opaque boxboard or translucent vegetable paper. However, opaque boxboard is a relatively poor light reflector. Vegetable paper also does not reflect light well and, in addition, does not allow light to be uniformly transmitted therethrough due to its irregular translucent characteristics. Unless chemically treated, paper shades pose a fire hazard.

Hard-backed lampshades have also been made of high-impact polystyrene ("HIPS") which contains butydene to allow the normally rigid styrene to be easily bent without cracking into a standard frusto-conical shape for the lampshade. The thickness of the known HIPS shades lies between 12–15 mils.

Although generally satisfactory for their intended purpose, the known HIPS shades have certain drawbacks. Thus, the presence of the butydene, as well as the thickness of the shade, act to block light from being transmitted through the lampshade. Also, the presence of the butydene renders the inner surface of the lampshade irregular, that is, not smooth, so that light is not efficiently reflected from this roughened surface. Unless chemically treated, any fabric laminated onto the HIPS shade represents a fire safety risk.

SUMMARY OF THE INVENTION

OBJECTS OF THE INVENTION

Accordingly, it is a general object of this invention to increase the reflectivity of light impinging on the lampshade.

More particularly, it is an object of the invention to increase the transmissivity of light passing through the lampshade.

Still another object of the present invention is so to provide a fire-retardant, self-supporting, strong lampshade.

A concomitant object of the invention is so to design the lampshade as to be simple in construction, inexpensive to manufacture, easy to use, and reliable in operation nevertheless.

FEATURES OF THE INVENTION

In pursuance of these objects and others which will become apparent hereafter, one feature of the present invention resides in a lampshade for a light source, comprising a self-supporting backing member or shell having upper and lower ends spaced apart along a longitudinal axis. The shell extends circumferentially about the axis to screen light emitted from the light source. The shell is constituted of an extruded oriented polystyrene having a total weight. A light-transmissive decorative fabric is laminated on the shell.

In accordance with this invention, an additive including a light-reflecting powdered filler is co-extruded with the oriented polystyrene. The filler weighs in the range of 1%–10% of said total weight. In the preferred embodiment, the powdered filler is titanium dioxide weighing in the range from 1%–9% of said total weight.

The filler reflects a greater proportion of light downwardly through the lower end of the shade. Hence, the oriented polystyrene shell with this filler increases the amount of downwardly reflected light than is currently available using a high impact polystyrene shell, assuming that the same light bulb is employed. This increase in light, typically used for reading, is very advantageous, and allows a lamp designer and manufacturer the freedom to use bulbs of lower wattage without sacrificing reading light output.

The additive may further include a fire-retarding filler, such as antimony oxide, preferably 1%–8% of said total weight, or decabromodiphenyl oxide, preferably 1%–10% of said total weight.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
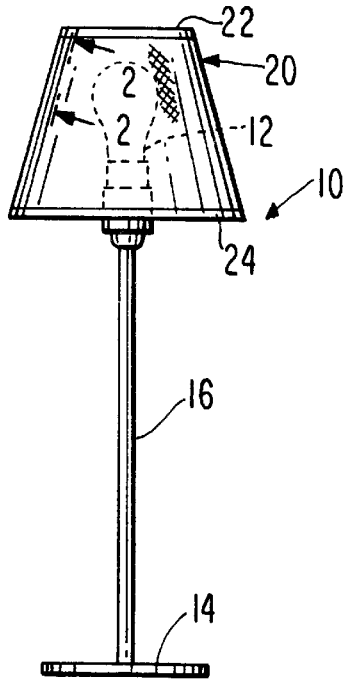
FIG. 1 is a front elevational view of a lamp on a reduced scale equipped with a hard-backed lampshade according to this invention.

Referring to FIG. 1, reference numeral 10 generally identifies a lamp having a lampshade 20 according to this invention. Although lamp 10 is shown to be a table lamp, it will be readily appreciated that other types of lamps can use the novel lampshade 20 described herein. Also, although the lampshade 20 is shown as having a frusto-conical shape, it will be understood by those skilled in this art that other shapes and configurations are likewise contemplated by this invention.

Figure 2:
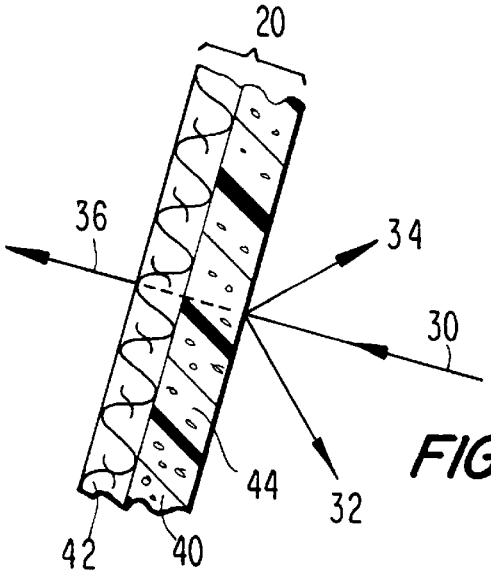
FIG. 2 is an enlarged sectional view of the lampshade taken on line 2—2 of FIG. 1.

The lampshade 20 has an upper open end 22 spaced apart along a longitudinal, vertical axis from a lower open end 24. The lampshade 20 extends in a circumferential direction completely around the longitudinal axis and surrounds a light bulb 12 which, when energized by electrical power in known manner, acts as a point source and emits light in all directions. Thus, some of the light travels directly through the upper and lower open ends 22, 24 of the shade, and the remainder of the light travels, as represented by the arrow 30 in FIG. 2, toward the shade 20.

The lampshade 20 is constituted of a self-supporting backing member or shell 40 on which a decorative layer, such as a fabric 42, is laminated. In accordance with this invention, the shell 40 is made of an oriented polystyrene ("OPS") extruded in sheet form having a thickness in the range of 7–14 mils, and bendable without cracking into the desired shape, e.g., a frusto-conical configuration. Before being so formed, the OPS sheet is calendared to impart a high gloss, mirror-like surface thereto. This reflective surface can be enhanced by using highly polished chromium rollers.

The light traveling toward the shade in the direction of the arrow 30 has a scattered component which scatters at the inner surface of the shell 40 in all directions, for example in the directions of the representative arrows 32, 34, as well as a transmitted component which is transmitted through the shell 40 and the fabric layer 42, if the latter is present, in the direction of the arrow 36. Refractive effects have not been illustrated for the sake of simplifying the drawing.

In accordance with this invention, an additive including a light-reflecting powdered filler 44 is co-extruded with the OPS sheet. The filler 44 weighs in the range of 1%–10% of the total weight of the OPS sheet. The amount of the filler 44 controls the opacity of the OPS sheet and, hence, the intensity of the transmitted and the scattered light components. The greater the amount of the filler by weight, the greater the opacity, the lesser the intensity of the transmitted light component, and the greater the intensity of the scattered light component.

With the filler in the above range, a lampshade can be made that reflects light downwardly (also called "downlight") through the lower open end 24 in a significantly greater amount than is currently available using a HIPS shell according to the prior art, even while transmitting virtually the same amount of light through the shell.

Preferably, the following fillers are used, in the indicated respective ratios by weight:

titanium dioxide 1%–9% zinc sulfide 1%–7% zinc oxide 1%–6%

The following comparative test was conducted: A 120V, 75 watt, incandescent bulb manufactured by the General Electric Company, and rated at 1190 lumens was illuminated in a distribution photometer, specifically a goniometer having a socket for receiving the bulb in an upper hemispherical part, and multiple detectors positioned at various angles around a lower hemispherical part. The lampshade itself was a HIPS shell, without any laminated fabric thereon, whose thickness was 14 mils nominal. The respective diameters of the upper and lower ends were 4.25 and 7.75 inches.

Figure 3:
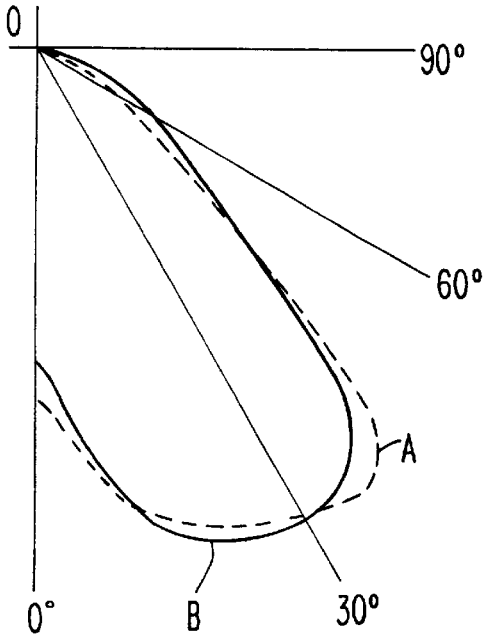
FIG. 3 is a graph comparing the variation in light intensity of a lamp having a lampshade according to the invention with a known lampshade according to the prior art.

The candlepower distribution of the downlight was measured by the goniometer in conventional manner in a plane through the light center. Turning to FIG. 3, the origin of the intersecting coordinate axes represents the center of the light bulb; the descending vertical axis represents 0° or vertically straight down from the bulb center; and the horizontal axis represents 90° or horizontally outwardly from the bulb center. The lines labeled 30° and 60° represent the zonal areas offset by 30° and 60° from the vertical axis.

Graph A shown in dashed lines in FIG. 3 represents a plot of the variation in luminous intensity of the bulb with the HIPS shade in candela per square meter measured in a plane through the light center at the indicated various zones angularly offset from the vertical axis, and is tabulated below in Table I.

Thereupon, a 120V, 60 watt incandescent bulb manufactured by the General Electric Company, and rated at 870 lumens was placed in the same photometer described above, except that the lampshade was an OPS shell, without any laminated fabric thereon, whose thickness was 8 mils nominal. The outside dimensions of the OPS shell were identical to the HIPS shell described above. The shell had 6% by weight of titanium dioxide co-extruded therewith. The same measurements were taken. Graph B shown in solid lines represents the plot of the average luminance and the values are also tabulated below in Table I.

TABLE I

| | LUMINANCE IN CANDELA PER SQUARE METER | |
|---|---|---|
| DEGREES | Graph A | Graph B |
| 0 | 3088 | 2628 |
| 45 | 4786 | 4135 |
| 55 | 2005 | 2463 |
| 65 | 1322 | 1710 |
| 75 | 1142 | 1269 |
| 85 | 1131 | 1131 |

It will be observed that the plots are virtually congruent. Each plot shows that the downlight concentrates most of its output directly beneath the bulb. Only one quadrant is shown, because the downlight is symmetrical about its centerline. The OPS shell with a 60 watt bulb reflected nearly as much light downwardly as a HIPS shell with a 75 watt bulb, without sacrificing the amount of light that passed through the shell. Thus, varying the amount of the powdered filler adjusts the amount of downwardly reflected light.

By reflecting more light away from the lampshade, there is a reduced tendency for heat to locally build up, possibly starting a fire. Hence, the powdered filler also serves a fire safety function.

For increased fire safety, a fire-retarding filler is added to the additive. This fire-retarding filler, in a preferred embodiment, is antimony oxide, preferably in the range of 1%–8% of said total weight. Alternatively, decabromodiphenyl oxide in the range of 1%–10% is employed, also for its fire-retardant properties. Both these fillers also serve to increase the structural strength of the shade.

The decorative fabric 42 can be constituted of various materials, e.g., polycottons, polyesters, jutes, and cottons. Decorative papers and films could also be used.

It will be understood that each of the elements described above, or two or more together, may also find a useful application in other types of constructions differing from the type described above.

While the present invention has been described and illustrated herein as embodied in a hard-backed lampshade, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalents of the following claims.

What is claimed as new and desired to be protected by Letters Patent is set forth in the appended claims:

1. A lampshade for a light source, comprising:

a) a self-supporting backing member having upper and lower ends spaced apart along a longitudinal axis, and extending circumferentially about said axis to screen light emitted from the light source, said backing member being constituted of an extruded oriented polystyrene having a total weight; and b) a permanent additive including a light-reflecting powdered filler co-extruded throughout the backing member with the oriented polystyrene and weighing in the range of 1%–10% of said total weight, the backing member reflecting more of the emitted light as the co-extruded filler increases in weight.

2. The lampshade according to claim 1, wherein the backing member has a frusto-conical shape.

3. The lampshade according to claim 1, wherein the oriented polystyrene has a thickness in the range of 7–14 mils.

4. The lampshade according to claim 1, wherein the backing member has a calendared inner surface.

5. The lampshade according to claim 1, wherein the powdered filler is titanium dioxide weighing in the range from 1%–9% of said total weight.

6. The lampshade according to claim 1, wherein the powdered filler is zinc sulfide weighing in the range from 1%–7% of said total weight.

7. The lampshade for according to claim 1, wherein the powdered filler is zinc oxide weighing in the range from 1%–6% of said total weight.

8. The lampshade according to claim 1; and further comprising a light-transmissive decorative layer laminated on the backing member.

9. The lampshade according to claim 8, wherein the decorative layer is a fabric.

10. The lampshade according to claim 9, wherein the fabric is a fire-retardant fabric.

11. The lampshade according to claim 1, wherein the additive also includes a fire-retarding powdered filler co-extruded with the oriented polystyrene.

12. The lampshade according to claim 11, wherein the fire-retarding filler is antimony oxide in the range of 1%–8% of said total weight.

13. The lampshade according to claim 11, wherein the fire-retarding filler is decabromodiphenyl oxide in the range of 1%–10% of said total weight.

14. A lampshade for a light source, comprising:

a) a self-supporting backing member having upper and lower ends spaced apart along a longitudinal axis, and extending circumferentially about said axis to screen light emitted from the light source, said backing member being constituted of an extruded oriented polystyrene having a total weight;

b) a light-transmissive decorative fabric laminated on the backing member; and c) a permanent additive including a light-reflecting powdered filler co-extruded throughout the backing member with the oriented polystyrene and weighing in the range of 1%–10% of said total weight, the backing member reflecting more of the emitted light as the co-extruded filler increases in weight.

15. The lampshade according to claim 14, wherein the powdered filler is titanium dioxide weighing in the range from 1%–9% of said total weight.

16. The lampshade according to claim 14, wherein the additive also includes a fire-retarding powdered filler co-extruded with the oriented polystyrene.

17. The lampshade according to claim 16, wherein the fire-retarding filler is antimony oxide in the range of 1%–8% of said total weight.

18. The lampshade according to claim 16, wherein the fire-retarding filler is decabromodiphenyl oxide in the range of 1%–10% of said total weight.

* * * * *